US009704436B2

(12) United States Patent
Xu et al.

(10) Patent No.: US 9,704,436 B2
(45) Date of Patent: Jul. 11, 2017

(54) PIXEL CIRCUIT, DRIVING METHOD THEREOF, ARRAY SUBSTRATE, AND DISPLAY DEVICE

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Pan Xu, Beijing (CN); Yongqian Li, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 14/917,158

(22) PCT Filed: Aug. 19, 2015

(86) PCT No.: PCT/CN2015/087510
§ 371 (c)(1),
(2) Date: Mar. 7, 2016

(87) PCT Pub. No.: WO2016/155206
PCT Pub. Date: Oct. 6, 2016

(65) Prior Publication Data

US 2017/0039948 A1 Feb. 9, 2017

(30) Foreign Application Priority Data

Apr. 3, 2015 (CN) ..... 2015 1 0159398

(51) Int. Cl.
*G09G 3/30* (2006.01)
*G09G 3/3258* (2016.01)
(Continued)

(52) U.S. Cl.
CPC ..... *G09G 3/3258* (2013.01); *G09G 3/32* (2013.01); *G09G 3/325* (2013.01); *G09G 3/3291* (2013.01);
(Continued)

(58) Field of Classification Search
CPC ..... G09G 3/30; G09G 3/32; G09G 3/3208; G09G 3/3216; G09G 3/3225; G09G 3/3233; G09G 3/325; G09G 3/3258
(Continued)

(56) References Cited

U.S. PATENT DOCUMENTS

2010/0117998 A1 5/2010 Yamashita et al.
2011/0279435 A1 11/2011 Tsai et al.
(Continued)

FOREIGN PATENT DOCUMENTS

CN 101465097 A 6/2009
CN 101739949 A 6/2010
(Continued)

OTHER PUBLICATIONS

Notification of the First Office Action dated Aug. 3, 2016 corresponding to Chinese application No. 201510159398.8.
(Continued)

*Primary Examiner* — Vijay Shankar
*Assistant Examiner* — Nelson Lam
(74) *Attorney, Agent, or Firm* — Nath, Goldberg & Meyer; Joshua B. Goldberg

(57) ABSTRACT

The present invention provides a pixel circuit, a driving method thereof, an array substrate, and a display device. The pixel circuit comprises: a reset unit, configured to output a reference signal; a data writing unit, configured to output a data signal; a compensation unit, which is connected to the reset unit and the data writing unit as well as an output node, and receives a power voltage signal, and a light-emitting
(Continued)

unit, which is connected to the output node and a cathode of a power supply and configured to emit light under the drive of the light emission drive signal in a light emission phase.

20 Claims, 6 Drawing Sheets

(51) Int. Cl.
*G09G 3/32* (2016.01)
*G09G 3/325* (2016.01)
*G09G 3/3291* (2016.01)

(52) U.S. Cl.
CPC ... *G09G 2300/043* (2013.01); *G09G 2310/08* (2013.01); *G09G 2330/021* (2013.01)

(58) Field of Classification Search
USPC ..... 345/76–83; 315/169.3
See application file for complete search history.

(56) References Cited

U.S. PATENT DOCUMENTS

2014/0055434 A1* 2/2014 Chang ..... G09G 3/3233 345/208
2014/0225878 A1* 8/2014 Shih ..... G09G 3/3258 345/205
2015/0130779 A1* 5/2015 Chang ..... G09G 3/3233 345/212
2015/0287364 A1* 10/2015 Chang ..... G09G 3/3258 345/77
2016/0232848 A1* 8/2016 Meng ..... G09G 3/3258
2017/0018229 A1* 1/2017 Zhang ..... G09G 3/3258

FOREIGN PATENT DOCUMENTS

CN 101980330 A 2/2011
CN 102542970 A 7/2012
CN 102568367 A 7/2012
CN 102568367 A1 7/2012
CN 104240644 A 12/2014
CN 104700783 A 6/2015

OTHER PUBLICATIONS

International Search Report dated Dec. 16, 2015 issued in corresponding International Application No. PCT/CN20151/087510 along with an English translation of the Written Opinion of the International Searching Authority.

* cited by examiner

PIXEL CIRCUIT, DRIVING METHOD THEREOF, ARRAY SUBSTRATE, AND DISPLAY DEVICE

This is a National Phase Application filed under 35 U.S.C. 371 as a national stage of PCT/CN2015/087510, filed Aug. 19, 2015, an application claiming the benefit of Chinese Application No. 201510159398.8, filed Apr. 3, 2015, the content of each of which is hereby incorporated by reference in its entirety.

FIELD OF THE INVENTION

The present invention relates to the field of display technology, in particular to a pixel circuit, a driving method thereof, an array substrate, and a display device.

BACKGROUND OF THE INVENTION

Due to its advantages of self-illumination, ultra-thin thickness, rapid response speed, high contrast ratio, wide angle of view and the like, an active matrix organic light-emitting diode (AMOLED) display becomes a display device attracting extensive attention at present.

The AMOLED display includes a plurality of pixels arranged in the form of a matrix. Each of the pixels is driven and controlled to perform display by a pixel circuit inside the pixel. The pixel circuit mainly includes: switch transistors, capacitors and an organic light-emitting diode (OLED) as a light-emitting device.

As shown in FIG. 1, a common pixel circuit includes three switch transistors, i.e., a control switch transistor Tc, a drive switch transistor Td and a power switch transistor Tv, and two capacitors, i.e., a first capacitor C1 and a second capacitor C2. The control terminal of the control switch transistor Tc receives a gate control signal Sc, and the input terminal of the control switch transistor Tc receives a data signal Data. The data signal Data has two potentials, i.e., a data potential Vdata and a reference potential Vref. The control terminal of the power switch transistor Tv receives a power control signal Sv, and the input terminal of the power switch transistor Tv receives a power voltage signal VDD. The control terminal of the drive switch transistor Td is connected to the output terminal of the control switch transistor Tc, and the input terminal of the drive switch transistor Td is connected to the output terminal of the power switch transistor Tv. A first terminal of the first capacitor C1 is connected to the control terminal of the drive switch transistor Td, and a second terminal of the first capacitor C1 is connected to the output terminal of the drive switch transistor Td. The output terminal of the control switch transistor Tc, the control terminal of the drive switch transistor Td and the first terminal of the first capacitor C1 are jointly connected to an input node n. The anode of a light-emitting device D is connected to the output terminal of the drive switch transistor Td, and the cathode of the light-emitting device D is connected to a cathode VSS of a power supply. A first terminal of the second capacitor C2 is connected to the anode of the light-emitting device D, and a second terminal of the second capacitor C2 is connected to the cathode of the light-emitting device D. The second terminal of the first capacitor C1, the output terminal of the drive switch transistor Td, the anode of the light-emitting device D and the first terminal of the second capacitor C2 are jointly connected to an output node p.

The inventor(s) of the present application found that the above pixel circuit has high power consumption and complicated driving method in practical applications.

SUMMARY OF THE INVENTION

To overcome the above shortcomings in the prior art, the present invention provides a pixel circuit, a driving method thereof, an array substrate and a display device, in order to reduce the power consumption of the pixel circuit and simplify the driving method of the pixel circuit.

One aspect of the present invention provides a pixel circuit, and a drive period of the pixel circuit successively includes a reset phase, a compensation phase, a data writing phase and a light emission phase. The pixel circuit includes: a reset unit, which receives a reference control signal and a reference signal whose potential is a reference potential, and is configured to output the reference signal under the control of the reference control signal in the reset phase and the compensation phase; a data writing unit, which receives a gate control signal and a data signal whose potential is a data potential, and is configured to output the data signal under the control of the gate control signal in the data writing phase; a compensation unit, which is connected to the reset unit and the data writing unit and further connected to an output node, receives a power voltage signal, and is configured to: in the reset phase, reset the potential of the output node by using the reference signal and the power voltage signal at a low potential; in the compensation phase, pull the potential of the output node from the reset potential up to a first potential by using the reference signal and the power voltage signal at a high potential; in the data writing phase, pull the potential of the output node from the first potential up to a second potential by using the data signal and the power voltage signal in a floating state; and in the light emission phase, under the action of the power voltage signal at a high potential, generate a light-emission drive signal and output the light-emission drive signal to the output node; and a light-emitting unit, which is connected to the output node and a cathode of a power supply, and is configured to emit light under the drive of the light-emission drive signal in the light emission phase.

According to an embodiment of the present invention, the reset unit may include a reset switch transistor, the control terminal of the reset switch transistor receives the reference control signal, the input terminal thereof receives the reference signal, and the output terminal thereof is connected to the compensation unit.

According to an embodiment of the present invention, the data writing unit may include a control switch transistor, the control terminal of the control switch transistor receives the gate control signal, the input terminal thereof receives the data signal, and the output terminal thereof is connected to the compensation unit.

According to an embodiment of the present invention, the compensation unit may include: a drive switch transistor and a first capacitor, the control terminal of the drive switch transistor is connected to the reset unit and the data writing unit, the input terminal of the drive switch transistor receives the power voltage signal, and the output terminal of the drive switch transistor is connected to the output node; a first terminal of the first capacitor is connected to the control terminal of the drive switch transistor, and a second terminal of the first capacitor is connected to the output terminal of the drive switch transistor.

According to an embodiment of the present invention, the light-emitting unit may include: a light-emitting device and a second capacitor, the anode of the light-emitting device is connected to the output node, and the cathode of the light-emitting device is connected to the cathode of the power supply; a first terminal of the second capacitor is connected to the anode of the light-emitting device, and a second terminal of the second capacitor is connected to the cathode of the light-emitting device.

According to an embodiment of the present invention, the pixel circuit may further include: a power supply unit, which is connected to the compensation unit, receives a power control signal and the power voltage signal, and is configured to: in the compensation phase and the light emission phase, output the power voltage signal at a high potential to the compensation unit under the control of the power control signal; in the reset phase, output the power voltage signal at a low potential to the compensation unit under the control of the power control signal; and in the data writing phase, allow the power voltage signal to be in a floating state under the control of the power control signal.

According to an embodiment of the present invention, the power supply unit may include a power switch transistor, the control terminal of the power switch transistor receives the power control signal, the input terminal thereof receives the power voltage signal, and the output terminal thereof is connected to the compensation unit.

Another aspect of the present invention provides a driving method of a pixel circuit, used for driving the pixel circuit according to the present invention. The pixel circuit includes a reset unit, a data writing unit, a compensation unit and a light-emitting unit, and a common end of the compensation unit and the light-emitting unit is an output node. The driving method includes a plurality of drive periods, each of which successively includes: a reset phase, in which a reference control signal and a reference signal whose potential is a reference potential are input to the reset unit, the reset unit outputs the reference signal to the compensation unit under the control of the reference control signal, and a power voltage signal at a low potential is input to the compensation unit, so as to reset the potential of the output node; a compensation phase, in which the reference control signal and the reference signal are input to the reset unit, the reset unit outputs the reference signal to the compensation unit under the control of the reference control signal, the power voltage signal at a high potential is input to the compensation unit, and the potential of the output node is pulled from the reset potential up to a first potential; a data writing phase, in which a gate control signal and a data signal whose potential is a data potential are input to the data writing unit, the data writing unit outputs the data signal to the compensation unit under the control of the gate control signal, the power voltage signal is made in a floating state, and the potential of the output node is pulled from the first potential up to a second potential; and a light emission phase, in which the power voltage signal at a high potential is input to the compensation unit, the compensation unit generates a light-emission drive signal under the action of the power voltage signal at a high potential, and the light-emission drive signal is used to drive the light-emitting unit to emit light.

Another aspect of the present invention provides an array substrate, including the pixel circuit according to the present invention.

Another aspect of the present invention provides a display device, including the array substrate according to the present invention.

According to the concept of the present invention, the power consumption of the pixel circuit may be reduced, and the driving method of the pixel circuit may be simplified.

BRIEF DESCRIPTION OF THE DRAWINGS

To describe the technical solutions of the embodiments of the present invention more clearly, the accompanying drawings to be used in the description of the embodiments will be briefly described below. It should be understood that the accompanying drawings in the following description illustrate merely some embodiments of the present invention, and a person of ordinary skill in the art may further obtain other drawings according to these accompanying drawings without any creative effort.

DETAILED DESCRIPTION OF THE EMBODIMENTS

As described in the background art, the pixel circuit in the prior art has high power consumption and complicated driving method. The pixel circuit in the prior art will be briefly analyzed below.

Figure 1:
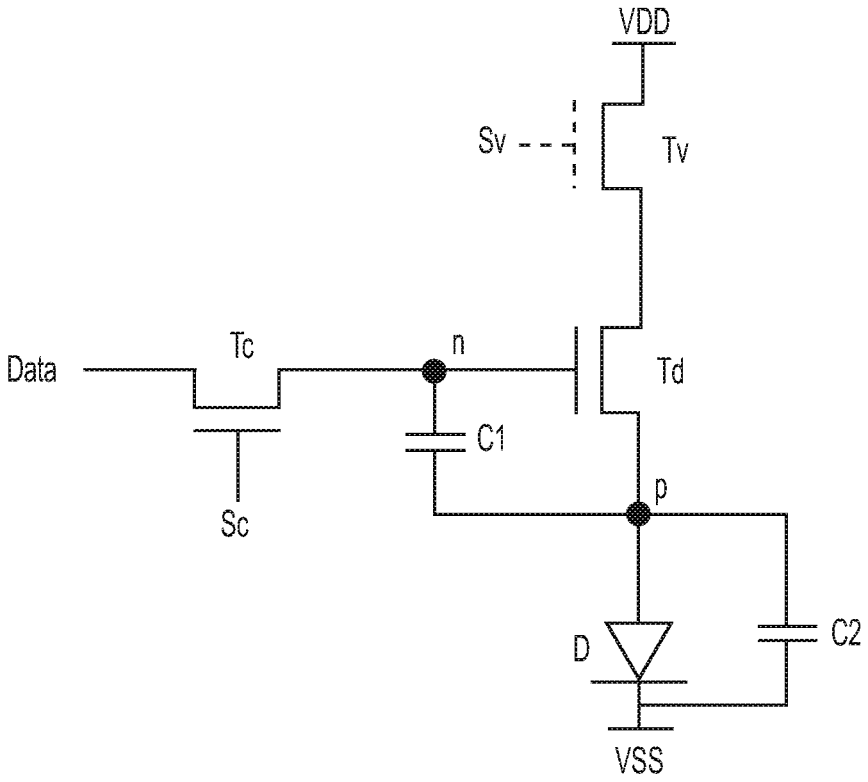
Fig. 1 (PRIOR ART)
FIG. 1 is a configuration diagram of a pixel circuit in the prior art.
Figure 2:
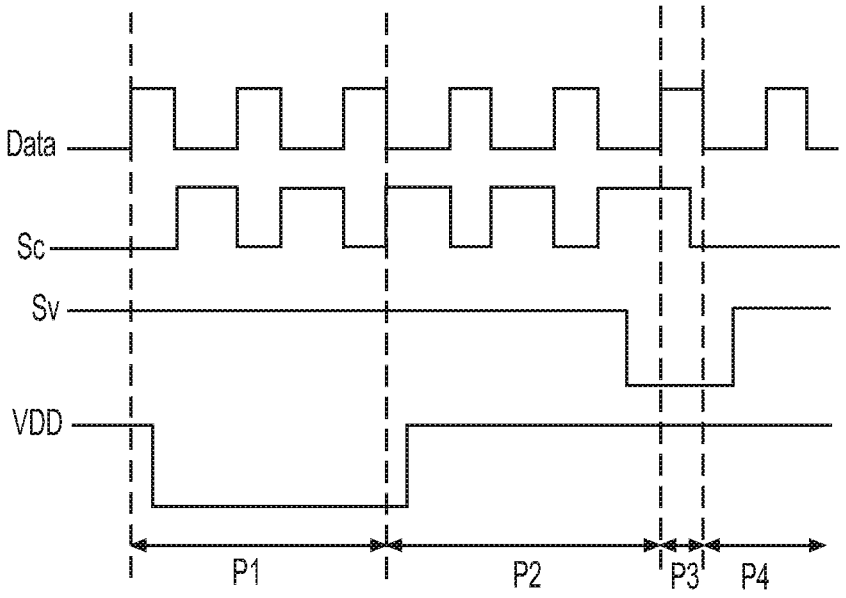
Fig. 2 (PRIOR ART)
FIG. 2 is a control timing diagram of the pixel circuit shown in FIG. 1.

FIG. 2 is a control timing chart of the pixel circuit in the prior art as shown in FIG. 1.

Referring to FIGS. 1 and 2, in the control timing of the pixel circuit in the prior art, one drive period (i.e., a period of displaying one frame of image) includes a reset phase P1, a compensation phase P2, a signal writing phase P3 and a light emission phase P4.

In the reset phase P1, when the gate control signal Sc is at a high potential, the control switch transistor Tc is turned on, and meanwhile the data signal Data is at a reference potential Vref (i.e., a low potential of the data signal Data in FIG. 2), so the potential Vn of the input node n satisfies Vn=Vref. A gate-source voltage Vgs of the drive switch transistor Td satisfies Vgs=Vn−Vp=Vref−Vp>Vth, where Vp is the potential of the output node p and Vth is a threshold voltage of the drive switch transistor Td. The drive switch transistor Td remains on-state. At this time, the power control signal Sv is at a high potential, so the power switch transistor Tv is turned on, and besides, the power voltage signal VDD is at a low potential, so the potential Vp of the output node p is reset to be a low potential.

In the compensation phase P2, the drive switch transistor Td remains on-state, and the power voltage signal VDD jumps to a high potential, so the potential Vp of the output node p begins to rise until it satisfies Vp=Vref−Vth. At this time, the gate-source voltage Vgs of the drive switch transistor Td satisfies Vgs=Vn−Vp=Vref−(Vref−Vth)=Vth, so the drive switch transistor Td is turned off. The potential Vn of the input node remains at the reference potential Vref, and the potential Vp of the output node p is (Vref−Vth).

In the signal writing phase P3, the power control signal Sv is at a low potential, and the power switch transistor Tv is turned off; meanwhile, the gate control signal Sc is at a high potential, and the control switch transistor Tc is turned on, so the data signal Data is written into the first capacitor C1, and the potential of the written data signal Data is a data potential Vdata (i.e., a high potential of the data signal Data in FIG. 2). The potential Vn of the input node n is raised from the reference potential Vref to the data potential Vdata. The potential Vp of the output node p is bootstrapped from (Vref−Vth) to [Vref−Vth+α(Vdata−Vref)], where α=C1/(C1+C2), C1 is a capacitance of the first capacitor C1 and C2 is a capacitance of the second capacitor C2.

In the light emission phase P4, the gate control signal Sc is at a low potential, the control switch transistor Tc is turned off, and the first capacitor C1 allows the potential Vn of the input node n to remain at the data potential Vdata. Meanwhile, the power control signal Sv is at a high potential, the power switch transistor Tv is turned on, the power voltage signal VDD is at a high potential, and the light-emitting device D begins to emit light.

The gray scale displayed by a frame of image is determined by the potential of the data signal Data, so the potential of the data signal is required to change from the data potential corresponding to a previous frame to the data potential corresponding to a current frame when the gray scale of the previous frame is changed into the gray scale of the current frame. According to a driving process in the prior art, in terms of one pixel, when the gray scale of the previous frame is changed into the gray scale of the current frame, the potential of the data signal Data first jumps from the data potential corresponding to the previous frame to the reference potential Vref and then jumps from the reference potential Vref to the data potential corresponding to the current frame.

Therefore, from the first frame to the $n^{th}$ frame, the jumping process of the potential of the data signal Data is as follows: Vdata1→Vref→Vdata2→Vref→Vdata3→Vref→ . . . →Vdatan (Vdata1 to Vdatan are data potentials of the data signal Data corresponding to the first frame to the $n^{th}$ frame, respectively). By the end of the driving of n frames, the potential of the data signal Data has jumped [2(n−1)] times, and the jumping frequency is high. In addition, as each data potential Vdata (i.e., from Vdata1 to Vdatan) is a high potential while the reference potential Vref is a low potential, each jump of the potential of the data signal Data involves a change between the high potential and the low potential, and thus the amplitude of the jump is large.

A calculation formula of the instantaneous power P of the potential jump of the data signal Data is as follows:

$$P = \frac{1}{2} C_L (V_{max}^2 - V_{min}^2) \times f,$$

where CL is the capacitance of a data line, Vmax is the maximum amplitude of the potential jump of the data signal Data, and Vmin is the minimum amplitude of the potential jump of the data signal Data. When the data potential Vdata of the data signal Data is very approximate to the reference potential Vref, the amplitude of the potential jump is very small, so the minimum amplitude may be considered as Vmin=0. Therefore, the instantaneous power P of the potential jump increases with the increase of the frequency f of the potential jump and also increases with the increase of the maximum amplitude Vmax of the potential jump. From the above deduction, both the frequency f and the amplitude of the potential jump of the data signal Data in the prior art are large, so the instantaneous power P of the potential jump of the data signal Data is high, resulting in high power consumption of the pixel circuit.

In addition, in the driving process of the pixel circuit in the prior art, during the process of displaying a frame of image, the potential of the gate control signal Sc is required to continuously switch between a high potential and a low potential. In addition, upon switch from a previous frame to a current frame, the data signal Data is required to jump twice. All these will complicate both the control timing and the existing driving method of the pixel circuit.

Figure 3:
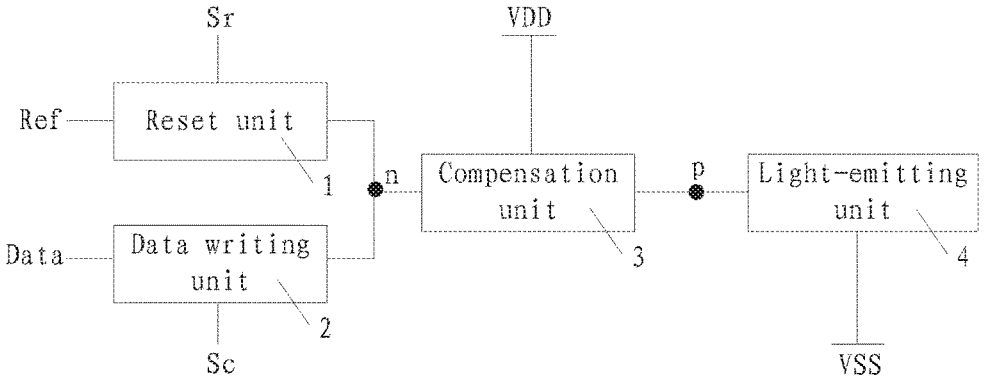
FIG. 3 is a schematic block diagram of a pixel circuit according to an embodiment of the present invention.
Figure 4:
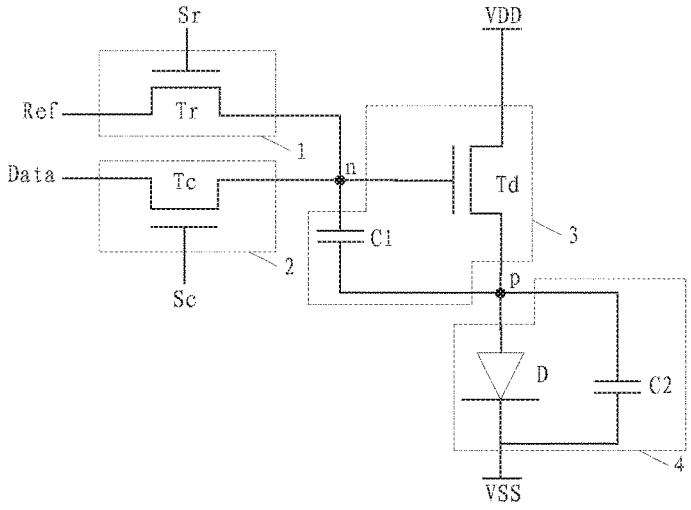
FIG. 4 is a schematic diagram illustrating a configuration of a pixel circuit according to an embodiment of the present invention.
Figure 5:
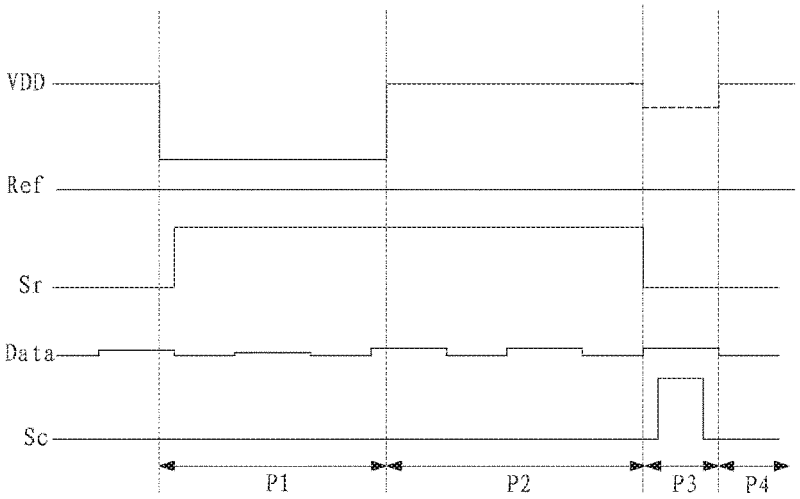
FIG. 5 is a control timing diagram of a pixel circuit according to an embodiment of the present invention.

FIG. 3 is a schematic block diagram of a pixel circuit according to an embodiment of the present invention, FIG. 4 is a schematic diagram of a configuration of the pixel circuit according to an embodiment of the present invention, and FIG. 5 is a control timing diagram of the pixel circuit according to an embodiment of the present invention.

Referring to FIG. 3, the pixel circuit according to an embodiment of the present invention includes a reset unit 1, a data writing unit 2, a compensation unit 3 and a light-emitting unit 4. The reset unit 1, the data writing unit 2 and the compensation unit 3 are jointly connected to an input node n of the pixel circuit, and the compensation unit 3 and the light-emitting unit 4 are jointly connected to an output node p of the pixel circuit. One drive period of the pixel circuit successively includes: a reset phase P1, a compensation phase P2, a data writing phase P3 and a light emission phase P4.

The reset unit 1 receives a reference control signal Sr and a reference signal Ref. The potential of the reference signal Ref is a reference potential Vref. The reset unit 1 is configured to output the reference signal Ref under the control of the reference control signal Sr in the reset phase and the compensation phase.

The data writing unit 2 receives a gate control signal Sc and a data signal Data. The potential of the data signal Data is a data potential Vdata. The data writing unit 2 is configured to output the data signal Data under the control of the gate control signal Sc in the data writing phase.

The compensation unit 3 is connected to the reset unit I and the data writing unit 2, and also connected to the output node p. The compensation unit 3 receives a power voltage signal VDD and is configured to: in the reset phase, reset the potential Vp of the output node p by using the reference signal Ref and the power voltage signal VDD at a low potential; in the compensation phase, pull up the potential Vp of the output node p from the reset potential to a first potential by using the reference signal Ref and the power voltage signal VDD at a high potential; in the data writing phase, pull up the potential Vp of the output node p from the first potential to a second potential by using the data signal Data and the power voltage signal VDD in a floating state; and in the light emission phase, under the action of the power voltage signal VDD at a high potential, generate a light emission drive signal and output the light emission drive signal to the output node p.

The light-emitting unit 4 is connected to the output node p and a cathode VSS of a power supply and configured to emit light under the drive of the light emission drive signal in the light emission phase.

Referring to FIG. 5, a driving method of a pixel circuit according to this embodiment includes a plurality of drive periods, each of which successively includes a reset phase P1, a compensation phase P2, a data writing phase P3 and a light emission phase P4.

In the reset phase P1, a reference control signal Sr and a reference signal Ref whose potential is reference potential Vref are input to the reset unit 1, so that the reset unit I is allowed to output the reference signal Ref to the compensation unit 3 under the control of the reference control signal Sr, and the power voltage signal VDD at a low potential is input to the compensation unit 3, so as to reset the potential Vp of the output node p.

In the compensation phase P2, the reference control signal Sr and the reference signal Ref are input to the reset unit 1, so that the reset unit 1 is allowed to output the reference signal Ref to the compensation unit 3 under the control of the reference control signal Sr, and the power voltage signal VDD at a high potential is input to the compensation unit 3, so that the potential Vp of the output node p is pulled from the reset potential up to a first potential.

In the data writing phase P3, a gate control signal Sc and a data signal Data whose potential is data potential Vdata are input to the data writing unit 2, so that the data writing unit 2 is allowed to output the data signal Data to the compensation unit 3 under the control of the gate control signal Sc, and the power voltage signal VDD is in a floating state, so that the potential Vp of the output node p is pulled up from the first potential to a second potential.

In the light emission phase, the power voltage signal VDD at a high potential is input to the compensation unit 3, so that the compensation unit 3 is allowed to generate a light emission drive signal under the action of the power voltage signal VDD at the high potential, and the light-emitting unit 4 is driven to emit light by the light emission drive signal.

In the pixel circuit and the driving method thereof according to this embodiment, by arranging a separate reset unit 1 to provide a reference signal Ref having a reference potential Vref to the compensation unit 3, the potential of the data signal Data is not required to first jump from the data potential corresponding to a previous frame to the reference potential Vref and then jump from the reference potential Vref to the data potential corresponding to a current frame, but can directly jump from the data potential corresponding to the previous frame to the data potential corresponding to the current frame, during the process of changing the gray scale of a previous frame of image to the gray scale of a current frame of image. Therefore, the jumping process of the potential of the data signal Data from the first frame to the $n^{th}$ frame is as follows: Vdata1→Vdata2→Vdata3→ . . . →Vdatan. Further, if the gray scales displayed by two or more successive frames of image are the same, the potential of the data signal Data is not required to jump, and thus the potential of the data signal Data jumps (n−1) times at most from the first frame to the $n^{th}$ frame, and the jumping frequency is at least reduced by half, as compared to [2(n−1)] jumps in the prior art. In addition, each jump of the potential of the data signal Data involves a change between two data potentials. As the data potential Vdata is always a high potential, each jump of the potential of the data signal Data is a jump between a high potential and another high potential. Therefore, compared to the prior art (where each jump of the potential of the data signal Data is a jump between a high potential (i.e., the data potential Vdata) and a low potential (i.e., the reference potential Vref)), the amplitude of jump is greatly reduced and the power consumption is thus effectively lowered.

In the pixel circuit according to the embodiment of the present invention, if the frame corresponding the maximum data potential Vdata(max) among all data potentials corresponding to n successive frames is adjacent to the frame corresponding to the minimum data potential Vdata(min), the maximum amplitude Vmax of the potential jump reaches maximum: Vmax=[Vdata(max)−Vdata(min)]. However, according to the prior art, the maximum amplitude Vmax of the potential jump is: [Vdata(max)−Vref]. As Vdata(min)>Vref, the maximum amplitude Vmax of the potential jump according to this embodiment is smaller than that in the prior art. According to the calculation formula of the instantaneous power p of the potential jump of the data signal Data:

$$P = \frac{1}{2} C_L (V_{max}^2 - V_{min}^2) \times f,$$

as the frequency f of the potential jump according to the embodiment of the present invention is at least less than a half of the frequency f of the potential jump in the prior art, and the maximum amplitude Vmax of the potential jump according to the embodiment of the present invention is smaller than that in the prior art, the power consumption of the pixel circuit according to the embodiment of the present invention is less than that in the prior art.

In addition, in the pixel circuit according to the embodiment of the present invention, the reset unit 1 operates in two successive phases (i.e., the reset phase and the compensation phase), so the reference control signal Sr for controlling the reset unit I allows the reset unit 1 to perform only one switching operation in each frame. The data writing unit 2 operates only in the data writing phase, so the gate control signal Sc for controlling the data writing unit 2 allows the data writing unit 2 to perform only one switching operation in each frame. In addition, the potential of the data signal Data jumps only when a change in gray scale occurs between two successive frames of image. These may simplify the control timing and thus simplify the driving method of the pixel circuit.

FIG. 4 shows a schematic diagram of a configuration of the pixel circuit according to the embodiment of the present invention.

As shown in FIG. 4, the reset unit I may include a reset switch transistor Tr. The control terminal of the reset switch transistor Tr receives the reference control signal Sr, the input terminal thereof receives the reference signal Ref, and the output terminal thereof is connected to the compensation unit 3.

The data writing unit 2 may include a control switch transistor Tc. The control terminal of the control switch transistor Tc receives the gate control signal Sc, the input terminal thereof receives the data signal Data, and the output terminal thereof is connected to the compensation unit 3.

The compensation unit 3 may include a drive switch transistor Td and a first capacitor C1. The control terminal of the drive switch transistor Td is connected to the reset unit 1 and the data writing unit 2, the input terminal thereof receives the power voltage signal VDD, and the output terminal thereof is connected to the output node p. A first terminal of the first capacitor C1 is connected to the control terminal of the drive switch transistor Td, and a second terminal thereof is connected to the output terminal of the drive switch transistor Td.

The light-emitting unit 4 may include a light-emitting device D and a second capacitor C2. The anode of the light-emitting device D is connected to the output node p, and the cathode thereof is connected to the cathode VSS of the power supply. A first terminal of the second capacitor C2 is connected to the anode of the light-emitting device D, and a second terminal thereof is connected to the cathode of the light-emitting device D.

FIGS. 6*a*-6*d* are working process diagrams of the pixel circuit according to the embodiment of the present invention within one drive period.

Figure 6A:
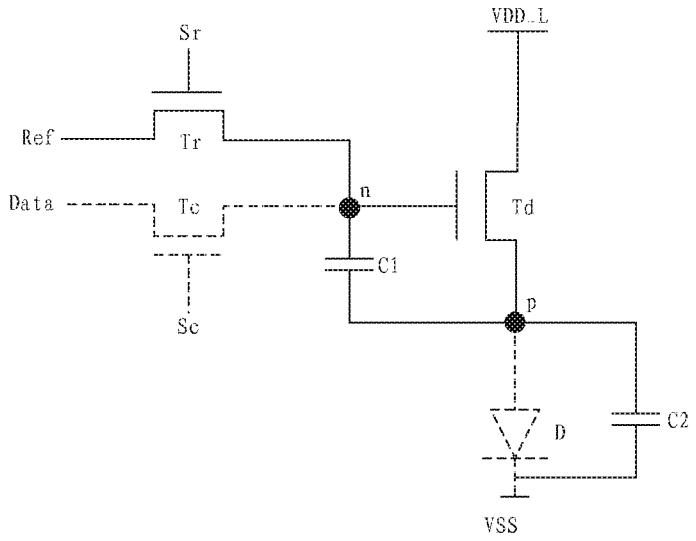
FIGS. 6*a*-6*d* are working process diagrams of a pixel circuit according to an embodiment of the present invention within one drive period.

Referring FIGS. 4, 5 and 6*a*, in the reset phase P1, the potential Vp of the output node p is reset to clear the information in the previous drive period. As shown in FIG. 6*a*, in the reset phase P1, the gate control signal Sc turns off the control switch transistor Tc, and the reference control signal Sr turns on the reset switch transistor Tr, so the output terminal of the reset switch transistor Tr outputs the reference signal Ref. Therefore, the potential Vn of the input node n is equal to the potential (i.e., the reference potential Vref) of the reference signal Ref, that is, Vn=Vref. At the resetting start time of the potential Vp of the output node p, the drive switch transistor Td is turned on. At this time, the power voltage signal VDD is set at a low potential VDD_L, so the potential Vp of the output node p is changed to the low potential VDD_L, and the gate-source voltage Vgs of the drive switch transistor Td satisfies: Vgs=Vn−Vp=Vref−VDD_L>Vth (i.e., the threshold voltage of the drive switch transistor Td). Thus, the drive switch transistor Td remains on-state, and the potential Vp of the output node p remains at the low potential VDD_L. It is to be noted that, although the drive switch transistor Td remains on-state in this phase, the light-emitting device D cannot emit light because Vp=VDD_L.

Figure 6B:
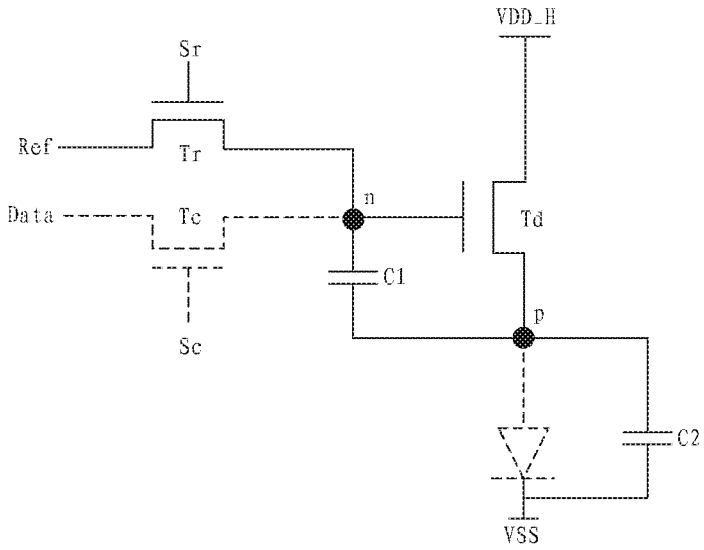

Referring to FIGS. 4, 5 and 6*b*, in the compensation phase P2, the potential Vp of the output node p is pulled from the reset potential (i.e., VDD_L) up to a first potential so as to compensate the potential Vp of the output node p. As shown in FIG. 6*b*, in the compensation phase P2, the gate control signal Sc makes the control switch transistor Tc remain off-state, while the reference control signal Sr makes the reset switch transistor Tr remain on-state, so the reference signal Ref is output to the input node n and the potential Vn of the input node n remains at Vref. At this time, while the drive switch transistor Td remains on-state, the power voltage signal VDD is set at a high potential VDD_H, so the potential Vp of the output node p is increased from VDD_L, the gate-source voltage Vgs of the drive switch transistor Td is reduced from (Vref−VDD_L) until Vgs=Vth, and the drive switch transistor Td is turned off. At this time, the potential Vp of the output node p satisfies Vp=Vref−Vth (i.e., the first potential). It is to be noted that, in this phase, when Vgs>Vth, the potential Vp of the output node p is not enough to drive the light-emitting device D to emit light although the drive switch transistor Td is turned on; when Vgs=Vth, the drive switch transistor Td is turned off, and the power voltage signal VDD at the high potential VDD_h cannot be transmitted to the output node p, so the light-emitting device D still does not emit light.

Figure 6C:
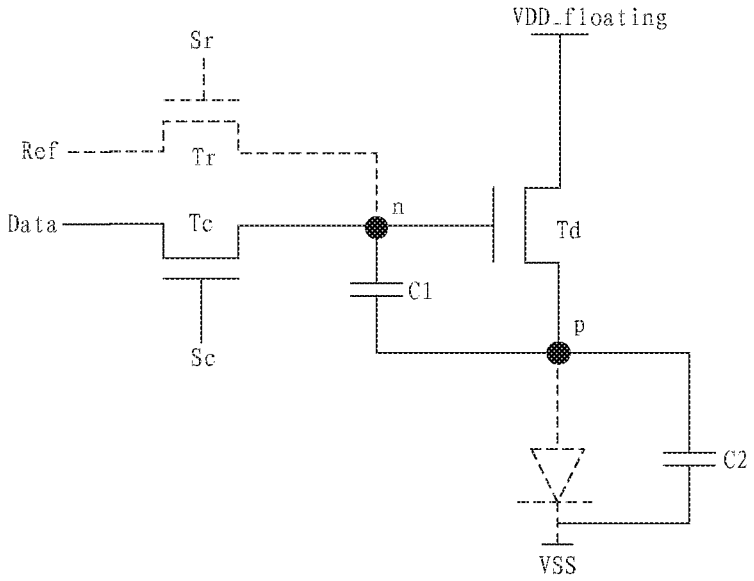

Referring to FIGS. 4, 5 and 6*c*, in the data writing phase P3, the potential Vp of the output node p is pulled from the first potential up to a second potential so as to eliminate the influence of the threshold voltage Vth of the drive switch transistor Td on the light-emitting device D. As shown in FIG. 6*c*, in the data writing phase P3, the reference control signal Sr turns off the reset switch transistor Tr, while the gate control signal Sc turns on the control switch transistor Tc, so that the control switch transistor Tc outputs the data signal Data to the input node n. As the output data signal Data is at the data potential Vdata, the potential Vn of the input node n is changed from the reference potential Vref to the data potential Vdata, that is, the variation of Vn is (Vdata−Vref). The potential Vn of the input node n is equal to Vdata, so the drive switch transistor Td is turned on. At this time, the power voltage signal VDD is cut off, and the potential of the power voltage signal VDD is in a floating state VDD_floating, so the first capacitor C1 generates a capacitance bootstrap effect and the potential Vp of the output node p is thus bootstrapped from (Vref−Vth) to the second potential. As the variation of the potential Vn of the input node n is (Vdata−Vref), the variation of the potential Vp of the output node p should be α(Vdata−Vref), where α=C1/(C1+C2), so the second potential should be: Vp=Vref−Vth+α(Vdata−Vref). It is to be noted that, in this phase, the light-emitting device D does not emit light as the power voltage signal VDD is cut off.

Figure 6D:
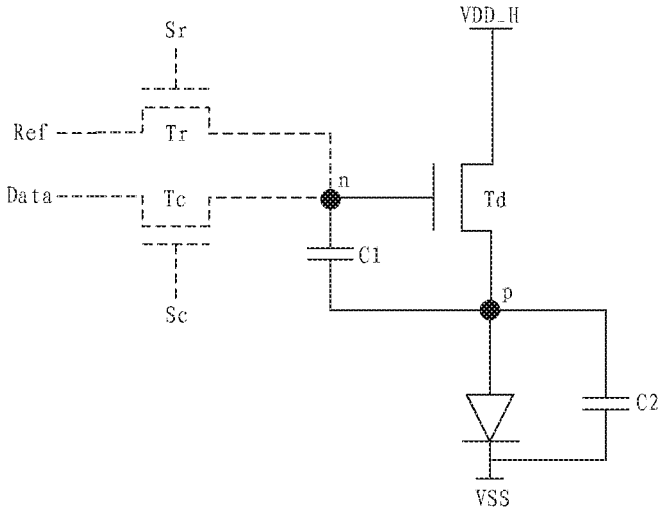

Referring to FIGS. 4, 5 and 6*d*, in the light emission phase P4, the drive switch transistor Td is turned on, and the power voltage signal VDD is at a high potential, so the light-emitting device D can be driven to be turned on and emit light. As shown in FIG. 6*d*, in the light emission phase P4, the reference control signal Sr turns off the reset switch transistor Tr, and the gate control signal Sc turns off the control switch transistor Tc, so the potential Vn of the input node n remains at the data potential Vdata, and the drive switch transistor Td is turned on. As the potential Vp of the output node p remains at [Vref−Vth+α(Vdata−Vref)], the gate-source voltage Vgs of the drive switch transistor Td keeps constant, i.e., Vgs=Vn−Vp=Vdata−[Vref−Vth+α(Vdata−Vref)]=(1−α)(Vdata−Vref)+Vth. According to the calculation formula of the working current of the light-emitting device D: $I_D=K(Vgs-Vth)^2$, where K is a constant, it may be obtained that: $I_D=K[(1-\alpha)(Vdata-Vref)+Vth-Vth]^2=K[(1-\alpha)(Vdata-Vref)]^2$, and the light-emitting device D emits light.

The pixel circuit shown in FIG. 4 includes three switch transistors and two capacitors. As compared to the pixel circuit in the prior art as shown in FIG. 1, there is no additional switch transistor and capacitor. In other words, the pixel circuit according to the embodiment of the present application can reduce the power consumption and simplify the driving method without increasing the complexity of the circuit.

In addition, according to the embodiment of the present invention, when the reference control signal Sr is controlled to turn on the reset switch transistor Tr and when the gate control signal Sc is controlled to turn on the control switch transistor Tc, the reference control signal Sr and the gate control signal Sc may be delayed to some extent (see the reset phase P1 and data writing phase P3 shown in FIG. 5), so as to avoid the problem of the surge current caused by suddenly turning on of the reset switch transistor Tr and the control switch transistor Tc. In addition, according to the embodiment of the present invention, when the gate control signal Sc is controlled to turn off the control switch transistor Tc, the gate control signal Sc may be controlled to turn off the control switch transistor Tc in advance (see the data writing phase P3 as shown in FIG. 5). This further facilitates the reduction of the power consumption of the pixel circuit. It is to be noted that, as the time required for turning on the control switch transistor Tc to change the potential Vn of the input node n to the data potential Vdata is very short, the control switch transistor Tc may be turned off in advance.

It is to be noted that, in the pixel circuit according to the embodiment of the present application, the working current $I_D=K[(1-\alpha)(Vdata-Vref)]^2$ of the light-emitting device D has nothing to do with the threshold voltage Vth of the drive switch transistor Td, so the problem of inconstant luminance of the light-emitting device D resulting from drift of the threshold voltage Vth of the drive switch transistor Td is eliminated.

FIG. 4 merely shows the specific implementation of the reset unit 1, the data writing unit 2, the compensation unit 3 and the light-emitting unit 4 of the pixel circuit by way of example, but these units may also be implemented in other ways in other embodiments of the present invention.

The power voltage signal VDD has three states, i.e., high potential, low potential and floating. These three states of the power voltage signal VDD may be provided by an external driver chip of an array substrate.

Figure 7:
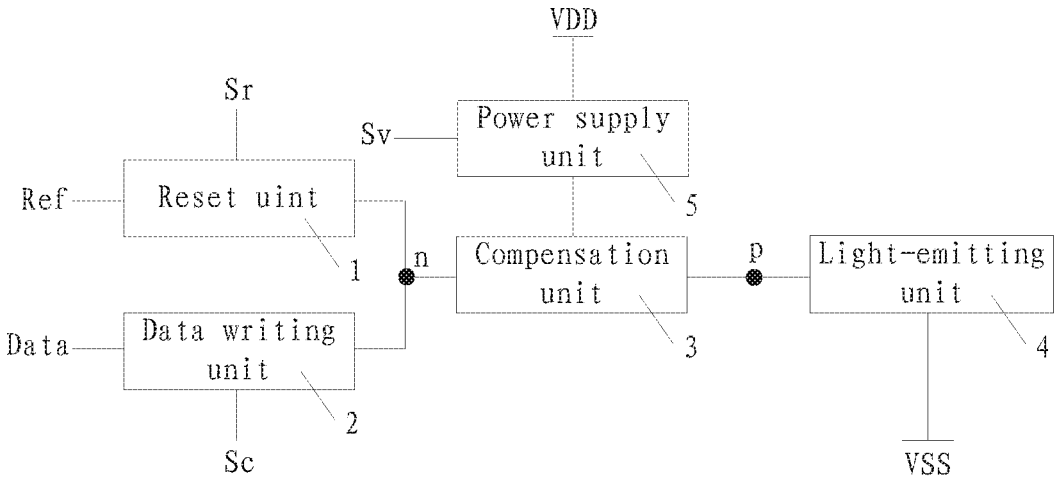
FIG. 7 is a schematic block diagram of a pixel circuit according to another embodiment of the present invention.
Figure 8:
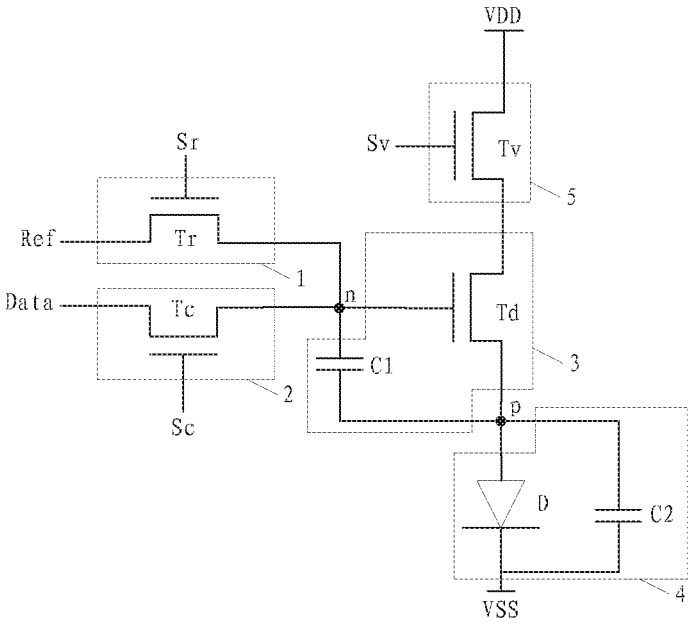
FIG. 8 is a schematic diagram illustrating a configuration of a pixel circuit according to another embodiment of the present invention.
Figure 9:
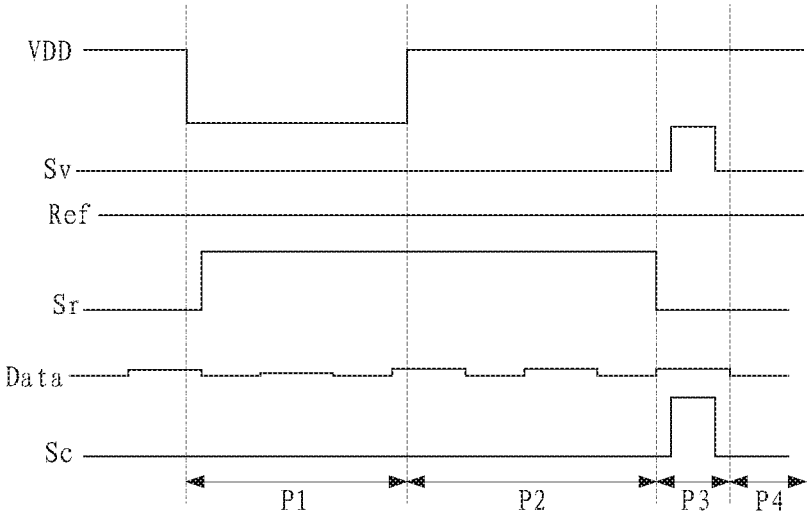
FIG. 9 is a control timing diagram of a pixel circuit according to another embodiment of the present invention.

FIG. 7 is a schematic block diagram of a pixel circuit according to another embodiment of the present invention, FIG. 8 is a schematic diagram of a configuration of the pixel circuit according to another embodiment of the present invention, and FIG. 9 is a control timing diagram of the pixel circuit according to another embodiment of the present invention. As compared to the embodiment shown in FIG. 3, in this embodiment shown in FIG. 7, a power supply unit 5 is added to provide the above three states of the power voltage signal VDD.

As shown in FIG. 7, the power voltage signal VDD is applied to the compensation unit 3 via the power supply unit 5. The power supply unit 5 receives a power control signal Sv and a power voltage signal VDD. The power supply unit 5 is configured to: in the compensation phase and the light emission phase, output the power voltage signal VDD at a high potential to the compensation unit 3 under the control of the power control signal Sv; in the reset phase, output the power voltage signal VDD at a low potential to the compensation unit 3 under the control of the power control signal Sv; and in the data writing phase, allow the power voltage signal VDD to be in a floating state under the control of the power control signal Sv.

Referring to FIG. 8, the power supply unit 5 may include a power switch transistor Tv. The control terminal of the power switch transistor Tv receives the power control signal Sv, the input terminal thereof receives the power voltage signal VDD, and the output terminal thereof is connected to the compensation unit 3.

Referring to FIG. 9, in the reset phase P1, the power control signal Sv is at a low potential to turn on the power switch transistor Tv. At this time, the power voltage signal VDD is at the low potential, so the output terminal of the power switch transistor Tv outputs the power voltage signal VDD at the low potential to the compensation unit 3. In the compensation phase P2, the power control signal Sv is still at the low potential which allows the power switch transistor Tv to remain on-state. At this time, the power voltage signal VDD is at a high potential, so the output terminal of the power switch transistor Tv outputs the power voltage signal VDD at the high potential to the compensation unit 3. In the data writing phase P3, the power control signal Sv is at the high potential to turn off the power switch transistor Tv, so the potential of the output terminal of the power switch transistor Tv is floating. In the light emission phase P4, the power control signal Sv is at the low potential to turn on the power switch transistor Tv, so the output terminal of the power switch transistor Tv outputs the power voltage signal VDD at the high potential to the compensation unit 3.

Although FIG. 9 shows an example in which the power switch transistor Tv is turned on when the power control signal Sv is at a low potential and turned off when the power control signal Sv is at a high potential, it is also possible to use a switch transistor which is turned off when the power control signal Sv is at a low potential and turned on when the power control signal Sv is at a high potential.

In this embodiment, by adding the switch transistor Tv, the state of the power voltage signal VDD may be either a high potential or a low potential, so the state change of the power voltage signal VDD itself is reduced.

The pixel circuit according to the embodiments of the present invention may be applied to an array substrate so that the array substrate has the advantages of low power consumption and simple driving method. Further, the array substrate may be applied to a display device so that the display device has the advantages of low power consumption and simple driving method. It is to be noted that the display device may be any product or component having a display function, such as a liquid crystal panel, electronic paper, an OLED panel, a mobile phone, a tablet computer, a TV set, a display, a notebook computer, a digital photo frame, a navigator or the like.

The foregoing description merely describes the specific implementations of the present invention by way of example, but the present invention is not limited thereto. Those skilled in the art may easily arrive at various variations or replacements according to the technical contents disclosed by the present invention, and all these variations or replacements shall fall into the protection scope of the present invention. Therefore, the protection scope of the present invention shall be subject to the protection scope of the claims.

The invention claimed is:

1. A pixel circuit, wherein a drive period of the pixel circuit successively comprises a reset phase, a compensation phase, a data writing phase and a light emission phase, and the pixel circuit comprises:

a reset unit, which receives a reference control signal and a reference signal whose potential is a reference potential, and is configured to output the reference signal under the control of the reference control signal in the reset phase and the compensation phase;

a data writing unit, which receives a gate control signal and a data signal whose potential is a data potential, and is configured to output the data signal under the control of the gate control signal in the data writing phase;

a compensation unit, which is connected to the reset unit and the data writing unit as well as an output node, receives a power voltage signal, and is configured to: in the reset phase, reset a potential of the output node by using the reference signal and the power voltage signal at a low potential; in the compensation phase, pull the potential of the output node from the reset potential up to a first potential by using the reference signal and the power voltage signal at a high potential; in the data writing phase, pull the potential of the output node from the first potential up to a second potential by using the data signal and the power voltage signal in a floating state; and in the light emission phase, under the action of the power voltage signal at a high potential, generate a light emission drive signal and output the light emission drive signal to the output node; and a light-emitting unit, which is connected to the output node and a cathode of a power supply, and configured to emit light under the drive of the light emission drive signal in the light emission phase.

2. The pixel circuit according to claim 1, wherein the reset unit comprises a reset switch transistor, a control terminal of the reset switch transistor receives the reference control signal, an input terminal thereof receives the reference signal, and an output terminal thereof is connected to the compensation unit.

3. The pixel circuit according to claim 2, wherein the pixel circuit further comprises:

a power supply unit, which is connected to the compensation unit, receives a power control signal and the power voltage signal, and is configured to: in the compensation phase and the light emission phase, output the power voltage signal at a high potential to the compensation unit under the control of the power control signal; in the reset phase, output the power voltage signal at a low potential to the compensation unit under the control of the power control signal; and in the data writing phase, allow the power voltage signal to be in a floating state under the control of the power control signal.

4. The pixel circuit according to claim 1, wherein the data writing unit comprises a control switch transistor, a control terminal of the control switch transistor receives the gate control signal, an input terminal thereof receives the data signal, and an output terminal thereof is connected to the compensation unit.

5. The pixel circuit according to claim 4, wherein the pixel circuit further comprises:

a power supply unit, which is connected to the compensation unit, receives a power control signal and the power voltage signal, and is configured to: in the compensation phase and the light emission phase, output the power voltage signal at a high potential to the compensation unit under the control of the power control signal; in the reset phase, output the power voltage signal at a low potential to the compensation unit under the control of the power control signal; and in the data writing phase, allow the power voltage signal to be in a floating state under the control of the power control signal.

6. The pixel circuit according to claim 1, wherein the compensation unit comprises:

a drive switch transistor, a control terminal of the drive switch transistor being connected to the reset unit and the data writing unit, an input terminal thereof receiving the power voltage signal, and an output terminal thereof being connected to the output node; and a first capacitor, a first terminal of the first capacitor being connected to the control terminal of the drive switch transistor, and a second terminal thereof being connected to the output terminal of the drive switch transistor.

7. The pixel circuit according to claim 6, wherein the pixel circuit further comprises:

a power supply unit, which is connected to the compensation unit, receives a power control signal and the power voltage signal, and is configured to: in the compensation phase and the light emission phase, output the power voltage signal at a high potential to the compensation unit under the control of the power control signal; in the reset phase, output the power voltage signal at a low potential to the compensation unit under the control of the power control signal; and in the data writing phase, allow the power voltage signal to be in a floating state under the control of the power control signal.

8. The pixel circuit according to claim 1, wherein the light-emitting unit comprises:

a light-emitting device, an anode of the light-emitting device being connected to the output node, and a cathode thereof being connected to a cathode of the power supply; and a second capacitor, a first terminal of the second capacitor being connected to the anode of the light-emitting device, and a second terminal thereof being connected to the cathode of the light-emitting device.

9. The pixel circuit according to claim 8, wherein the pixel circuit further comprises:

a power supply unit, which is connected to the compensation unit, receives a power control signal and the power voltage signal, and is configured to: in the compensation phase and the light emission phase, output the power voltage signal at a high potential to the compensation unit under the control of the power control signal; in the reset phase, output the power voltage signal at a low potential to the compensation unit under the control of the power control signal; and in the data writing phase, allow the power voltage signal to be in a floating state under the control of the power control signal.

10. The pixel circuit according to claim 1, wherein the pixel circuit further comprises:

a power supply unit, which is connected to the compensation unit, receives a power control signal and the power voltage signal, and is configured to: in the compensation phase and the light emission phase, output the power voltage signal at a high potential to the compensation unit under the control of the power control signal; in the reset phase, output the power voltage signal at a low potential to the compensation unit under the control of the power control signal; and in the data writing phase, allow the power voltage signal to be in a floating state under the control of the power control signal.

11. The pixel circuit according to claim 10, wherein the power supply unit comprises a power switch transistor, a control terminal of the power switch transistor receives the power control signal, an input terminal thereof receives the power voltage signal, and an output terminal thereof is connected to the compensation unit.

12. A driving method of a pixel circuit, used for driving the pixel circuit of claim 1, wherein the pixel circuit comprises a reset unit, a data writing unit, a compensation unit and a light-emitting unit, a common end of the compensation unit and the light-emitting unit is an output node, and the driving method comprises a plurality of drive periods, each of which successively comprises:

a reset phase, in which a reference control signal and a reference signal whose potential is a reference potential are input to the reset unit, the reset unit outputs the reference signal to the compensation unit under the control of the reference control signal, and a power voltage signal at a low potential is input to the compensation unit, so as to reset the potential of the output node;

a compensation phase, in which the reference control signal and the reference signal are input to the reset unit, the reset unit outputs the reference signal to the compensation unit under the control of the reference control signal, the power voltage signal at a high potential is input to the compensation unit, and the potential of the output node is pulled from the reset potential up to a first potential;

a data writing phase, in which a gate control signal and a data signal whose potential is a data potential are input to the data writing unit, the data writing unit outputs the data signal to the compensation unit under the control of the gate control signal, the power voltage signal is made in a floating state, and the potential of the output node is pulled from the first potential up to a second potential; and a light emission phase, in which the power voltage signal at a high potential is input to the compensation unit, the compensation unit generates a light emission drive signal under the action of the power voltage signal at a high potential, and the light emission drive signal is used to drive the light-emitting unit to emit light.

13. An array substrate, comprising the pixel circuit of claim 1.

14. The array substrate according to claim 13, wherein the reset unit of the pixel circuit comprises a reset switch transistor, a control terminal of the reset switch transistor receives the reference control signal, an input terminal thereof receives the reference signal, and an output terminal thereof is connected to the compensation unit.

15. The array substrate according to claim 13, wherein the data writing unit of the pixel circuit comprises a control switch transistor, a control terminal of the control switch transistor receives the gate control signal, an input terminal thereof receives the data signal, and an output terminal thereof is connected to the compensation unit.

16. The array substrate according to claim 13, wherein the compensation unit of the pixel circuit comprises:

a drive switch transistor, a control terminal of the drive switch transistor being connected to the reset unit and the data writing unit, an input terminal thereof receiving the power voltage signal, and an output terminal thereof being connected to the output node; and a first capacitor, a first terminal of the first capacitor being connected to the control terminal of the drive switch transistor, and a second terminal thereof being connected to the output terminal of the drive switch transistor.

17. The array substrate according to claim 13, wherein the light-emitting unit of the pixel circuit comprises:

a light-emitting device, an anode of the light-emitting device being connected to the output node, and a cathode thereof being connected to a cathode of the power supply; and a second capacitor, a first terminal of the second capacitor being connected to the anode of the light-emitting device, and a second terminal thereof being connected to the cathode of the light-emitting device.

18. The array substrate according to claim 13, wherein the pixel circuit further comprises:

a power supply unit, which is connected to the compensation unit, receives a power control signal and the power voltage signal, and is configured to: in the compensation phase and the light emission phase, output the power voltage signal at a high potential to the compensation unit under the control of the power control signal; in the reset phase, output the power voltage signal at a low potential to the compensation unit under the control of the power control signal; and in the data writing phase, allow the power voltage signal to be in a floating state under the control of the power control signal.

19. The array substrate according to claim 18, wherein the power supply unit comprises a power switch transistor, a control terminal of the power switch transistor receives the power control signal, an input terminal thereof receives the power voltage signal, and an output terminal thereof is connected to the compensation unit.

20. A display device, comprising the array substrate of claim 13.

* * * * *